United States Patent [19]

Terazawa et al.

[11] Patent Number: 4,995,363

[45] Date of Patent: Feb. 26, 1991

[54] THROTTLE CONTROLLER

[75] Inventors: Tadashi Terazawa, Toyota; Hiroshi Nakashima, Nishio; Yoshinori Taguchi, Nagoya, all of Japan

[73] Assignee: Aisin Seiki Kabushiki Kaisha, Kariya, Japan

[21] Appl. No.: 523,026

[22] Filed: May 14, 1990

[30] Foreign Application Priority Data

May 29, 1989 [JP] Japan ..... 1-135253

[51] Int. Cl.[5] ..... F02D 11/10

[52] U.S. Cl. ..... 123/399

[58] Field of Search ..... 123/361, 399

[56] References Cited

U.S. PATENT DOCUMENTS

| | | | |
|---|---|---|---|
| 4,727,840 | 3/1988 | Nishida et al. | 123/399 |
| 4,809,659 | 3/1989 | Tamaki et al. | 123/399 |
| 4,831,985 | 5/1989 | Mabee et al. | 123/399 |
| 4,892,071 | 1/1990 | Asayama | 123/399 |
| 4,896,640 | 1/1990 | Pfalzgraf et al. | 123/399 |
| 4,898,138 | 2/1990 | Nishimura et al. | 123/399 |
| 4,938,327 | 7/1990 | Tominaga | 123/361 |

*Primary Examiner*—Willis R. Wolfe

*Attorney, Agent, or Firm*—Burns, Doane, Swecker & Mathis

[57] ABSTRACT

A throttle controller has a first detecting device for outputting a signal corresponding to an amount of the accelerator operation of an accelerator operating mechanism; a second detecting device for outputting a signal corresponding to an opening of a throttle valve; a first controlling device for permitting drive control by a drive controlling device in such a manner that a clutch device separates a throttle opening and closing device from a driving device, when an output signal of the first detecting device is a signal representative of an amount of operation not more than a predetermined amount of accelerator operation and when an output signal of the second detecting means is a signal representative of an opening exceeding a predetermined throttle opening; and a second controlling device disposed in parallel with and independently of the first controlling device and adapted to permit control of the driving of the clutch device by the drive controlling device, the second controlling device permitting control of the driving of the clutch device by the drive controlling device in such a manner that the clutch device connects the throttle opening and closing device and the driving device, when an output signal of the first detecting device is a signal representative of an amount of operation not more than the predetermined amount of accelerator operation and when an output signal of the second detecting device is a signal representative of an opening exceeding the predetermined throttle opening.

3 Claims, 9 Drawing Sheets

THROTTLE CONTROLLER

BACKGROUND OF THE INVENTION

1. Field of the Invention

The present invention relates to a throttle controller mounted in an internal combustion engine, and more particularly to a throttle controller which controls the opening and closing of a throttle valve in response to the operation of an accelerator by means of a driving source such as a motor and which is capable of effecting various types of control such as control of constant-speed running by means of a drive controlling means.

2. Description of the Related Art

A throttle valve of an internal combustion engine is adapted to control a fuel-air mixture in a carburetor and an output of the internal combustion engine in an electronically controlled gasoline injector by adjusting the amount of air intake. The throttle valve is arranged to be interlocked with an accelerator operating mechanism including an accelerator pedal.

Although, conventionally, the accelerator operating mechanism is mechanically connected to the throttle valve, apparatus have recently been proposed for opening and closing the throttle valve in response to the operation of an accelerator by means of a driving means interlocking with a driving source such as a motor. For instance, Japanese Patent Laid-Open No. 14586/1980 discloses an apparatus in which a stepping motor is connected to a throttle valve and the stepping motor is driven in response to the operation of an accelerator pedal.

With respect to such apparatus, Japanese Patent Laid-Open No. 1539/1984 enumerates examples of conventional countermeasures against cases where an electronically controlled actuator for driving the aforementioned stepping motor has become uncontrollable. For instance, the arrangement provided is such that a throttle shaft is separated from the electronically controlled actuator by means of an electromagnetic clutch, and the throttle valve is returned to its closed position by means of a return spring. In this publication, countermeasures are provided on the grounds that no driving means are provided in the aforementioned conventional examples for opening and closing the throttle valve after control by the electronically controlled actuator is stopped, which makes it impossible to move the vehicle to a specified place for repair.

Specifically, the arrangement provided is as follows: An electromagnetic clutch is interposed between the throttle shaft and a rotating shaft which rotates as the accelerator pedal is pressed, the electromagnetic clutch being adapted to disengage the two shafts when it is excited, and couples the two shafts when not excited. Also interposed between the two shafts is a control circuit which is adapted to drive a relay upon detecting any abnormality in the control operation of the electronically controlled actuator, thereby stopping power supply to the electronically controlled actuator and the electromagnetic clutch. When the electronically controlled actuator has become uncontrollable, the throttle shaft is mechanically connected to the accelerator pedal via the electromagnetic clutch.

In the technique disclosed in the aforementioned publication of Japanese Patent Laid-Open No. 153945/1984, the uncontrollable state of the electronically controlled actuator is detected by another control circuit, and the power supply to the actuator and the electromagnetic clutch is stopped by this control circuit. It is stated in the publication that after control is stopped, the rotating shaft mechanically connected to the accelerator pedal is connected to the throttle shaft via the electromagnetic clutch. In addition, even after the operation has shifted to the operation by the accelerator pedal, the state in the accelerator pedal is still connected to the actuator is maintained, as it is explained concerning the operation of an embodiment that since drive torque is not produced in the motor in a state in which the electronically controlled actuator has stopped control, the accelerator pedal can be pressed with only a light force, and that no hindrance is therefore caused to the opening and closing of the throttle valve by the pressing of the accelerator pedal.

However, the electromagnetic clutch used in such conventional apparatus is large in size in terms of its structure, and its cost is high. In addition, it cannot be said that the possibility of not only the electronically controlled actuator becoming uncontrollable but also the aforementioned control circuits malfunctioning is nil. For instance, there is the possibility that the throttle valve continues to be driven toward the opening side owing to, for instance, radio interference or the like. In such a case, even if a switching means is provided separately, and an attempt is made to connect the throttle shaft to the accelerator pedal with the power supply to the electromagnetic clutch stopped, there is no means for actuating the throttle valve toward the closing side in opposition to the throttle shaft driven by the actuator, so that it becomes difficult to secure a desired throttle opening.

If the above-described situation has occurred, the driver generally stops the operation of the accelerator and effects a braking operation. With the above-described conventional apparatus, however, the throttle valve continues to be driven by the actuator.

For this reason, the subject applicant has disclosed in Japanese Patent Application No. 22190/1989 a throttle controller in which the driving means can be separated positively from the throttle valve and throttle control by the driving source can be stopped, when the stopping of the operation of the accelerator is detected and when it is detected that a predetermined throttle opening is exceeded then.

In the aforementioned throttle controller as well, the function of controlling running at a constant speed is required for allowing the vehicle to run at a fixed speed even if the accelerator pedal is not pressed once the vehicle speed is set to a desired speed during running of the vehicle. However, if the arrangement is provided such that the driving means is separated from the throttle valve when the throttle opening has exceeded a predetermined opening when the operation of the accelerator is stopped, as described above, the driving means is separated with the operation of the accelerator stopped during running of the vehicle. In this state, the constant speed running control becomes impossible. Accordingly, during control of constant-speed running, it is essential to allow throttle control by the driving source to continue even when the accelerator is not operated.

In addition, during running of the vehicle by constant-speed running control, the accelerator pedal is normally in an nonoperative state, and if the constant-speed running control is canceled is this state, the throttle opening becomes sharply small. Subsequently, the operation proceeds immediately to the normal accelerator control, and the driving source is driven in response to the operation of the accelerator until the throttle valve reaches a desired opening. However, drivability is impaired due to the aforementioned sharp decline in throttle opening.

SUMMARY OF THE INVENTION

Accordingly, an object of the present invention is to provide a throttle controller for effecting throttle control by a driving source during constant-speed running control as well, wherein, when the stopping of the operation of an accelerator is detected except at the time of constant-speed running control and when it is detected that a predetermined throttle opening is exceeded, a driving means can be positively separated from a throttle valve so as to stop throttle control by the driving source, and wherein the throttle opening can be made to shift smoothly to a desired opening when constant-speed running control is canceled.

To this end, in accordance with the present invention, there is provided a throttle controller including throttle opening and closing means M1 for opening and closing a throttle valve 11, urging means M2 for urging the throttle opening and closing means M1 in a direction in which the throttle valve 11 is closed, an accelerator operating mechanism M3, driving means M4 capable of driving the throttle opening and closing means M1 independently of the accelerator operating mechanism M3 in directions in which the throttle valve 11 is opened and closed, a driving source M5 for rotatively driving the driving means M4, clutch means M6 for connecting and disconnecting the throttle opening and closing means M1 and the driving means M4, and drive controlling means M7 for controlling the engagement and disengagement of the clutch means M6 and controlling the driving of the driving source M5 in response to at least the accelerator operation of the accelerator operating mechanism M3, the throttle controller comprising: first detecting means M8 for outputting a signal corresponding to an amount of the accelerator operation of the accelerator operating mechanism M3; second detecting means M9 for outputting a signal corresponding to an opening of the throttle valve 11; first controlling means M10 for permitting drive control by the drive controlling means M7 in such a manner that the clutch means M6 separates the throttle opening and closing means M1 from the driving means M4, when an output signal of the first detecting means M8 is a signal representative of an amount of operation not more than a predetermined amount of accelerator operation and when an output signal of the second detecting means M9 is a signal representative of an opening exceeding a predetermined throttle opening; and second controlling means M11 disposed in parallel with and independently of the first controlling means M10 and adapted to permit control of the driving of the clutch means M6 by the drive controlling means M7, the second controlling means M11 permitting control of the driving of the clutch means M6 by the drive controlling means M7 in such a manner that the clutch means M6 connects the throttle opening and closing means M1 and the driving means M6, when an output signal of the first detecting means M8 is a signal representative of an amount of operation not more than the predetermined amount of accelerator operation and when an output signal of the second detecting means M9 is a signal representative of an opening exceeding the predetermined throttle opening.

In the above-described throttle controller, it is preferred that the second controlling means M11 permits control of the driving of the clutch means M6 by the drive controlling means M7, during constant-speed running control for effecting control in such a manner that the opening of the throttle valve 11 maintains vehicle speed at a constant speed.

In addition, an arrangement may be provided such that the clutch means M6 is constituted by an electromagnetic clutch mechanism, first controlling means M10 and the second controlling means M11 respectively including a first energizing circuit and a second energizing circuit respectively connected to the electromagnetic clutch clutch mechanism, and switching means being disposed in the second energizing circuit in series therewith and adapted to switch on and off energization of the electromagnetic clutch mechanism in interlinking relation with a brake pedal of a vehicle.

The throttle controller arranged as described above is mounted in an unillustrated internal combustion engine. When the accelerator operating mechanism M3 is in an initial position in which it is in a predetermined state at the time when it is nonoperative, the throttle opening and closing means M1 is separated from the driving means M4. If the running of the internal combustion engine is commenced, the two members are connected by the clutch means M6 and assume a state in which they are capable of rotating as a unit. Then, the driving means M4 is rotatively driven by the driving source M5 in response to control by the drive controlling means M7, and the opening and closing of the throttle valve 11 is controlled via the throttle opening and closing means M1.

In this state, by controlling the driving source M5 irrespective of the accelerator operating mechanism M3 and by rotatively driving the driving means M4, it is possible to open and close the throttle valve 11, and by controlling the driving source M5 as required, various types of control, including constant-speed running control, are effected. In other words, during constant-speed running control, a setting can be provided such that the second controlling means M11 permits control of the driving of the clutch means M6 by means of the drive control means M7 irrespective of the first control means M10, so that the drive means M4 and the throttle opening and closing means M1 are connected together. Then, the driving means M4 is rotatively driven by the driving source M5 in response to control by the drive controlling means M7, and the opening and closing of the throttle valve 11 is controlled in such a manner as to maintain a predetermined vehicle speed.

If the second control means M11 is to be used only for constant-speed running control, except at the time of constant-speed running control, the driving means M4 and the throttle opening and closing means M1 are not connected to each other unless the accelerator operation is effected. That is, at the time when an output signal of the first detection means M8 is a signal representative of an amount of operation not more than a predetermined amount of accelerator operation, when the throttle valve 11 is opened and an output signal of the second detecting means M9 becomes a signal representing that the throttle opening detected exceeds a predetermined throttle opening, the first controlling means M10 permits control of the driving of the clutch means M6 by the drive controlling means M7 in such a manner that the throttle opening and closing means M1 is separated from the driving means M4. Accordingly, even if a malfunctioning of the drive controlling means M7, an abnormal operation of the driving source M5, or the like should occur, a situation does not occur in which the throttle valve 11 opens against the will of the driver.

In addition, during running of the vehicle under constant-speed running control, when the accelerator operating mechanism M3 is in a nonoperative state, an output signal of the first detecting means is a signal representative of an amount of operation not more than a predetermined amount of accelerator operation. In this state, even if the constant-speed running control is canceled, the throttle opening and closing means M1 and the driving means M4 are connected to each other via the clutch means M6 insofar as the signal output of the second detecting means M9 is a signal representing an opening exceeding a predetermined throttle opening. In short, the second controlling means M11 permits control of the driving of the clutch means M6 by the drive controlling means M7 in such a manner that the state of connection between the throttle opening and closing means M1 and the driving means is maintained, until an output signal of the first detecting means M8 reaches a signal representative of an amount of operation exceeding a predetermined amount of accelerator operation through the operation of the accelerator operating mechanism M3.

The other objects, features and advantages of the present invention will become more apparent from the following detailed description of the invention when read in conjunction with the accompanying drawings.

DESCRIPTION OF THE PREFERRED EMBODIMENTS

Referring now to the accompanying drawings, a description will be given of the preferred embodiments of a throttle controller in accordance with the present invention.

Figure 1:
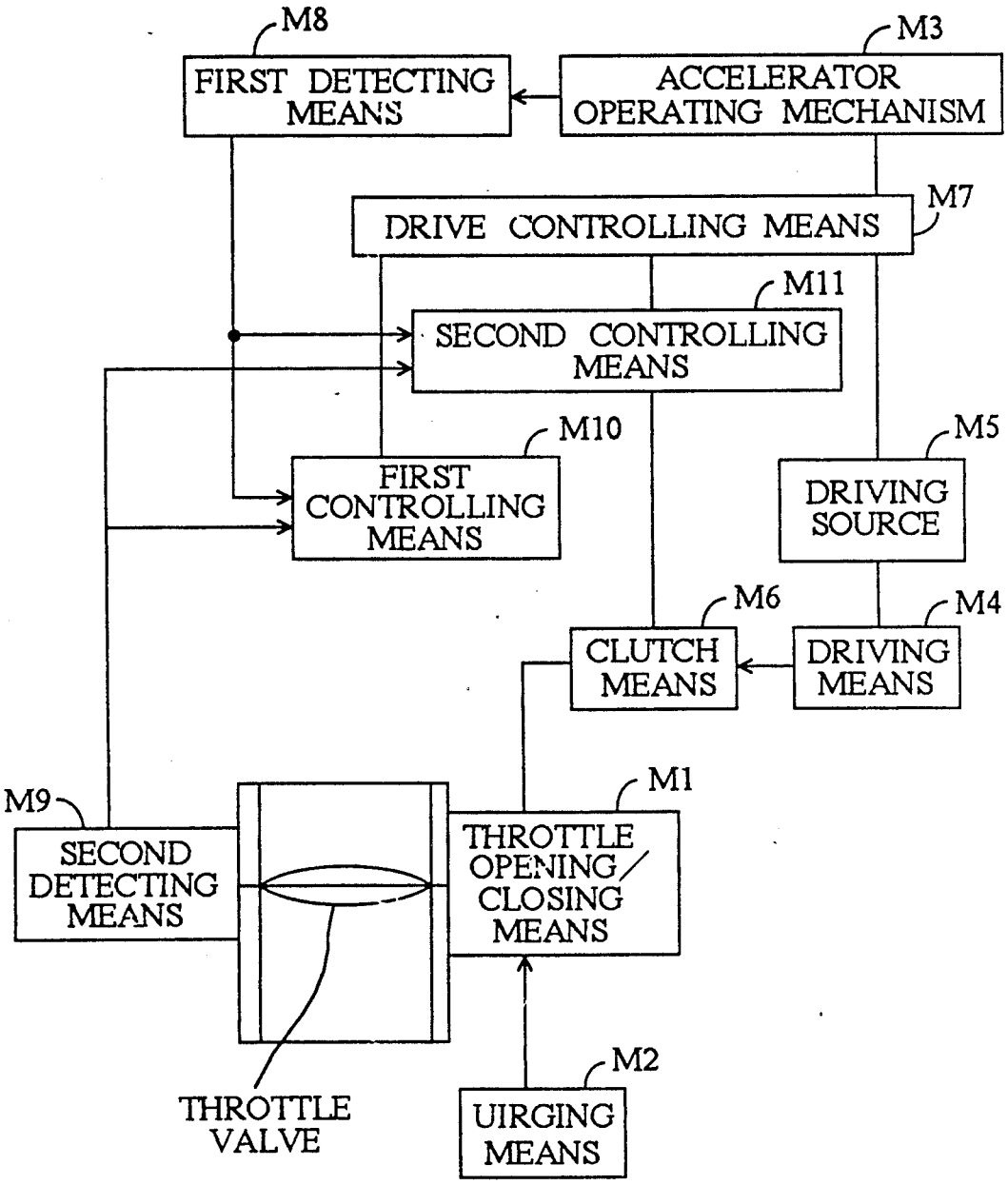
FIG. 1 is a block diagram illustrating an outline of a throttle controller in accordance with the present invention.
Figure 2:
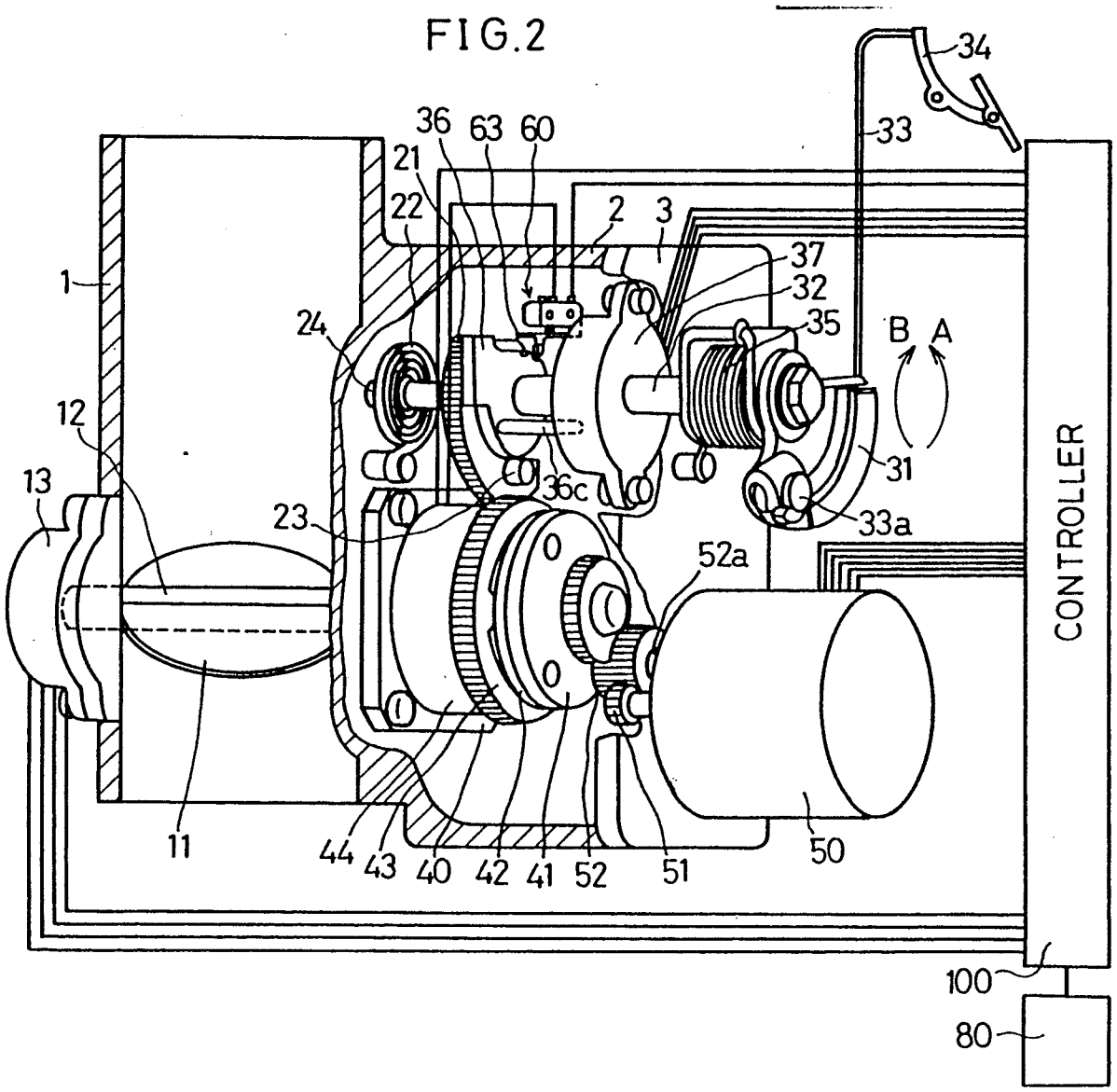
FIG. 2 is a partially cutaway perspective view of an embodiment of the throttle controller in accordance with the present invention.
Figure 3:
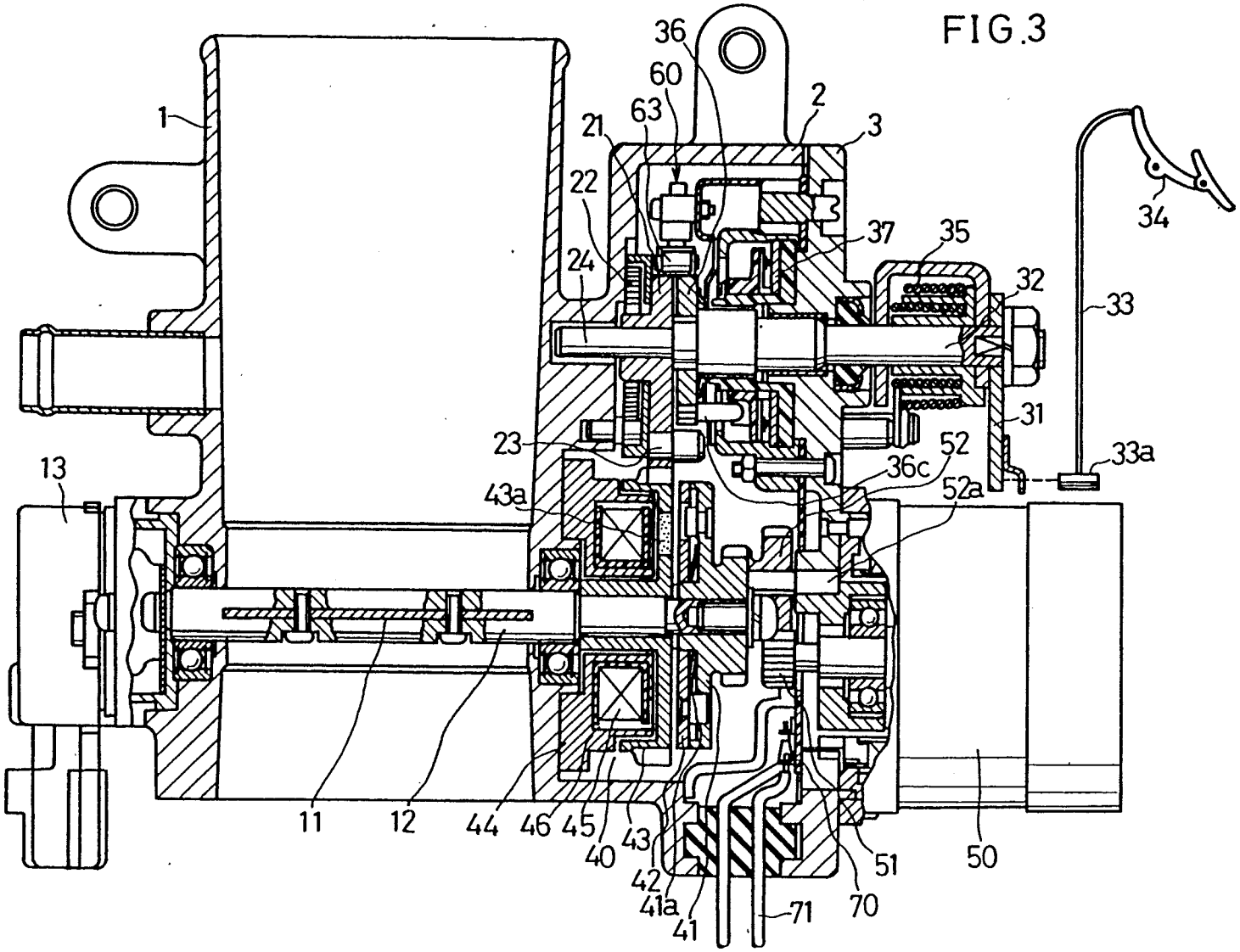
FIG. 3 is a vertical cross-sectional view thereof.

As shown in FIGS. 2 and 3, a throttle valve 11 is supported in an intake passage in a throttle body 1 of an internal combustion engine in such a manner as to be rotatable by a throttle shaft 12. A case is formed integrally on a side surface of the throttle body 1 on which one end of the throttle shaft 12 is supported. A cover 3 is connected to the case 2, and some of the component parts constituting the throttle controller in accordance with this embodiment are accommodated in a chamber defined by the case 2 and the cover 3. In addition, a throttle sensor 13 is mounted on an opposite side surface of the throttle body 1, on which the other end of the throttle shaft 12 is supported, to the case 2.

The throttle sensor 13 has a detector for detecting the opening of the throttle valve 11 and is connected to the throttle shaft 12. The rotational displacement of the throttle shaft 12 converted to an electrical signal, and, for instance, an idling switch signal and a throttle opening signal are output to a controller 100.

A movable yoke 43 formed of a magnetic member is affixed to the other end of the throttle shaft 12, and the throttle valve 11 is arranged to rotate integrally with the movable yoke 43. As is apparent from FIG. 3, the movable yoke 43 has a configuration of a circular dish and is provided with a shaft portion secured to the throttle shaft 12. The movable yoke 43 is fitted with a fixed yoke 44 similarly formed of a magnetic member and having a substantially identical configuration. The two yokes 43, 44 are fitted with a predetermined interval with their respective opening ends opposed to each other and with their respective side walls and shaft portions axially superposed on each other. The fixed yoke 44 is secured to the throttle body 1, and a coil 45 wound around a nonmagnetic bobbin 46 is accommodated in a space formed between the shaft portions and the side walls. A nonmagnetic friction member 43*a* is embedded in the bottom of the movable yoke 43 around the throttle shaft 12, while a driving plate 41, which serves as the driving means referred to in the present invention, is disposed in face-to-face relation with the friction member 43*a* via a disk-shaped magnetic clutch plate 42. These members constitute an electromagnetic clutch mechanism 40 serving as the clutch means referred to in the present invention.

The driving plate 41 is a member having a configuration of a circular dish provided with a shaft portion in its center, and the shaft portion is rotatably supported around the throttle shaft 12. An external gear is formed integrally on the shaft portion of the driving plate 41 and is arranged to mesh with an external gear formed on a small-diameter portion of a gear 52 which will be described later. As shown in FIG. 3, the aforementioned clutch plate 42 is connected to the bottom of the driving plate 41 via a leaf spring 41*a*. The clutch plate 42 is urged toward the driving plate 41 by this leaf spring 41*a* and is hence spaced apart from the movable yoke 43 when the coil 45 is not being energized.

The gear 52 meshing with the driving plate 41 has a stepped cylindrical configuration having a small-diameter portion and a large-diameter portion each having an external gear formed thereon, and is rotatably supported around a shaft 52*a* secured to the cover 3. A motor 50 serving as the driving source referred to in the present invention is secured to the cover 3, and its rotating shaft is supported rotatably in parallel to the shaft 52*a*. A gear 51 is affixed to the tip of the rotating shaft of the motor 50, and meshes with the external gear of the large-diameter portion of the gear 52. In the apparatus of this embodiment, a stepping motor is used as the motor 50, and its drive is controlled by the controller 100. It should be noted that another type of motor, such as a DC motor, can be used as the motor 50.

When the motor 50 is rotatively driven and the gear 51 is rotated, the gear 52 rotates, and the driving plate 41 meshing therewith rotates around the throttle shaft 12 together with the clutch plate 42. At this time, if the coil 45 shown in FIG. 3 is not being energized, the clutch plate 42 is spaced apart from the movable yoke 43 by means of the urging force of the leaf spring 41*a*. In other words, in this case, the movable yoke 43, the throttle shaft 12, and the throttle valve 11 are in a state in which they are capable of rotating freely irrespective of the driving plate 41. When the movable yoke 43 and the fixed yoke 44 are excited, the clutch plate 42 is attracted toward the movable yoke 43 by an electromagnetic force against the urging force of the leaf sprig 41*a*, and is brought into contact with the movable yoke 43. As a result, the clutch plate 42 and the movable yoke 43 are set in a frictionally engaging state, and the two members rotate in a abutting state, coupled with the action of the friction member 43*a*. That is, in this case, the driving plate 41, the clutch plate 42, the movable yoke 43, the throttle shaft 12, and the throttle valve 11 are rotatively driven as a unit by the motor 50 via the gears 51, 52.

An accelerator shaft 32 is rotatably supported by the cover 3 in parallel with the throttle shaft 12 in such a manner as to project outside the cover 3. An accelerator link 31 constituting a rotating lever is affixed to a projecting end of the accelerator shaft 32, and a pin 33*a* secured to one end of an accelerator cable 33 is retained by the tip of the accelerator link 31. A return spring 35 is connected to the accelerator link 31 and urges the accelerator link 31 and the accelerator shaft 32 in the direction in which the throttle valve 11 is closed. The other end of the accelerator cable 33 is connected to an accelerator pedal 34, and the accelerator link 31 and the accelerator shaft 32 rotate around the axis of the accelerator shaft 32 in response to the operation of the accelerator pedal 34, thereby constituting an accelerator operation mechanism.

A tabular accelerator plate 36 is secure between the throttle body 1 and the cover 3, i.e., on the accelerator shaft 32 inside the case 2, and a tabular throttle plate 21 is secured to small-diameter portion 24 of the accelerator shaft 32 in such a manner as to oppose the accelerator plate 36.

Figure 5A:
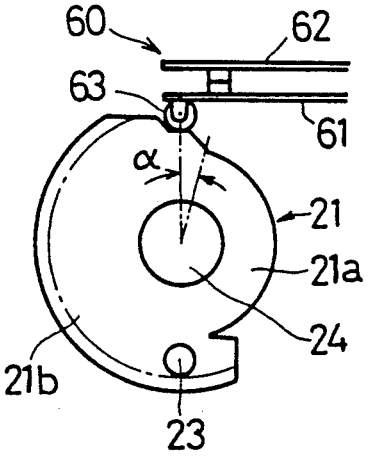
FIGS. 5A and 5B are schematic diagrams illustrating relative positional relationships between the limit switch and a throttle plate, FIG. 5A illustrating a state in which the throttle plate is in an initial position, and FIG. 5A illustrating a state in which the throttle plate is rotatively driven.
Figure 5B:
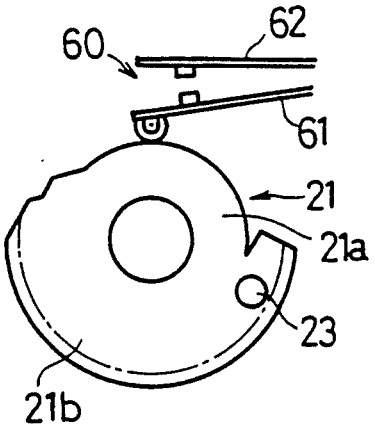

As its plan view is shown in FIGS. 5A and 5B, the throttle plate 21 is constituted by a small-diameter portion 21*a* with its central portion supported by the small-diameter portion 24 of the shaft 32, as well as a large-diameter portion 21*b*. As is apparent from FIG. 2, external teeth are formed on the outer side surface of the large-diameter portion 21*b*. The external teeth of the throttle plate 21 mesh with the external teeth formed on the movable yoke 43, and the movable yoke 43 rotate in response to the rotation of the throttle plate 21, which in turn causes and throttle shaft 12 connected integrally therewith and the throttle valve 11 to rotate. The throttle plate 21 and the movable yoke 43 constitute the throttle opening and closing means referred to in the present invention.

In addition, as shown in FIGS. 5A and 5B, a step is formed on a connecting portion between the small-diameter portion 21*a* and the large-diameter portion 21*b* of the throttle plate 21, and an end cam is formed by its outer peripheral side surface. A radial side surface of the large-diameter portion 21*b* is disposed in such a manner as to face an unillustrated stopper provided on the case 2, and the rotation of the throttle plate 21 is restricted by the stopper. A pin 23 is affixed to the large-diameter portion 21*b* of the throttle plate 21. As shown in FIGS. 2 and 3, an end of a return spring 22 is retained at a shaft portion of the throttle plate 21, and the other end thereof is retained by a pin embedded in the case 2. Accordingly, the throttle plate 21 is urged by the urging force of the return spring 22 in a direction in which the side surface of the large-diameter portion 21*b* is brought into contact with the case 2. In short, the throttle plate 21 is urged in the direction of arrow B shown in FIG. 2, i.e., in the direction in which the throttle valve 11 is closed, by means of the return spring 22 serving as the urging means referred to in the present invention.

Figure 4A:
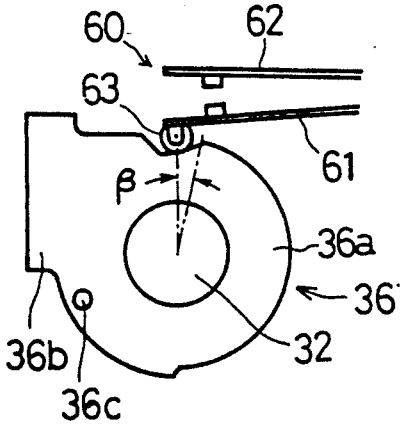
FIGS. 4A and 4B are schematic diagrams illustrating relative positional relationships between a limit switch and an accelerator plate in the embodiment shown in FIGS. 2 and 3, FIG. 4A illustrating a state in which the accelerator plate is in an initial position, and FIG. 4B illustrating a state in which the accelerator plate is rotatively driven.
Figure 4B:
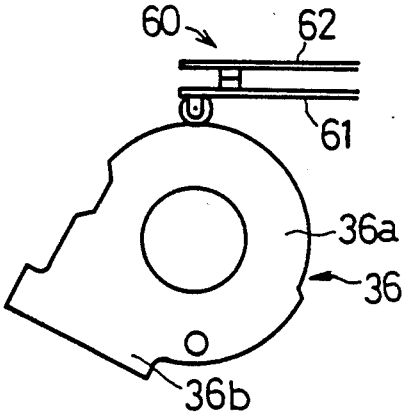

As its plan view is shown in FIGS. 4A and 4B, the accelerator plate 36 comprises a disk portion 36*a* with its central portion secured to the accelerator shaft 32 as well as an arm 36*b* extending in the radial direction. A portion of the disk portion 36*a* connected to the arm 36*b* has a small diameter, and a recess is formed therein, while an end cam is constituted by its outer peripheral side surface. The arm 36*b* is arranged such that one side surface thereof in its rotating direction is opposed to an unillustrated stopper provided on the case 2, while the other side surface thereof is opposed to the pin 23 of the throttle plate 21. In short, the arrangement provided is such that when the accelerator plate 36 rotates counterclockwise as viewed in FIG. 4 and its arm 36*b* abuts against the pin 23 of the throttle plate 21, the accelerator plate 36 and the throttle plate 21 rotate as a unit.

The accelerator 36 has its arm 36*b* urged in the direction of arrow B shown in FIG. 2 by means of the urging force of the return spring 35 shown in FIGS. 2 and 3, and the state shown in FIG. 2 is the state in which the accelerator plate 36 and the throttle plate 21 are in their initial position. In addition, when the driving plate 41 is connected to the movable yoke 43 by means of the electromagnetic clutch mechanism 40, the throttle valve 11 is rotatively driven by the motor 50. Should the controller 100, which will be described below, or the motor 50 fail, the throttle valve 11 can be opened by depressing the accelerator pedal 34 by not less than a predetermined amount, causing the arm 36*b* of the accelerator plate 36 to abut against the pin 23 of the throttle plate 21. It should be noted that a pin 36*c* projecting in the axial direction of the accelerator shaft 32 is embedded in the accelerator plate 36.

An accelerator sensor 37 is secured around an outer periphery of a bearing of the accelerator shaft 32 formed on the cover 3. The accelerator sensor 37 is provided with a known structure, and is constituted by both an unillustrated member forming a thick-film resistor and a brush opposed thereto, the brush being disposed in such a manner as to engage the pin 36c of the accelerator plate 36. The rotational angle of the accelerator shaft 32 rotating integrally with the accelerator plate 36 is detected by the accelerator sensor 37. This accelerator sensor 37 is electrically connected to a printed circuit board 70 interposed between the case 2 and the cover 3, the printed circuit board 70 being electrically connected to the controller 100 via a lead 71.

In addition, as shown in FIG. 3, a limit switch 60 interlocking with both the throttle plate 21 and the accelerator plate 36 is secured to the case 3 via a stay, and is electrically connected to the printed circuit board 70. As schematically shown in FIGS. 4 and 4, the limit switch 60 has a pair of resilient leads 60, 62 respectively having opposing contacts, a roller 63 being secured to a distal end portion of one lead 61. It should be noted that a sliding member may be used instead of the roller 63.

As is apparent from FIGS. 2 and 3, the roller 63 is urged by the resiliency of the lead 61 in such a manner as to abut against the respective outer peripheral side surfaces of the throttle plate 21 and the accelerator plate 36. Accordingly, the roller 63 follows the respective end cams formed on the throttle plate 21 and the accelerator plate 36, and the opposing contact of the lead 61 moves into contact with or away from the opposing contact of the lead 62 in response to the following operation of the roller 63. The first detecting means referred to in the present invention is constituted by this limit switch 60 and the accelerator plate 36, and a second detecting means is constituted by the limit switch 60 and the throttle plate 21.

FIG. 4A illustrates an initial state in which the accelerator pedal 34 shown in FIG. 2 has not been operated. Specifically, the roller 63 of the limit switch 60 is opposed to the small-diameter portion of the disk portion 36a of the accelerator plate 36, and is pressed by the urging force of the lead 61 in such a manner as to abut against an outer peripheral side surface of the small-diameter portion. Accordingly, the opposing contacts of the leads 61, 62 are spaced apart from each other.

When the accelerator pedal 34 is operated, the accelerator plate 36 rotates counterclockwise as viewed in FIG. 4, which causes the roller 63 to be brought into contact with the outer side surface of the disk portion 36a of the roller 63, and assumes the state shown in FIG. 4B. In short, the opposing contacts of the leads 61, 62 are brought into contact with each other, closing the leads 61, 62 and rendering the coil 45 of the electromagnetic clutch mechanism 40 excitable.

FIG. 5A shows a state in which the throttle plate 21 is urged by the return spring 22 and is in its initial position, and the throttle valve 11 shown in FIG. 2 is in its closed position. At this time, the roller 63 of the limit switch 60 is in contact with the large-diameter portion 21b of the throttle plate 21. Hence, the opposing contacts of the leads 61, 62 are in contact with each other, and the leads 61, 62 are closed and are in the state of rendering the coil 45 of the electromagnetic clutch mechanism excitable.

When the movable yoke 43 of the electromagnetic clutch mechanism 40 is rotatively driven counterclockwise as viewed in FIG. 5 by the motor 50 via the clutch plate 42 by exceeding a predetermined angle, the relevant parts assume the state shown in FIG. 5B. In other words, when the throttle plate 21 is rotatively driven by exceeding a predetermined angle $\alpha$, the roller 63 of the limit switch 60 abuts against the small-diameter portion 21a of the throttle plate 21, the lead 61 is spaced apart from the lead 62, and their opposing contacts are made open, thereby de-energizing the coil 45 of the electromagnetic clutch mechanism 40.

Since the roller 63 of the limit switch 60 is disposed in such a manner as to oppose the respective outer peripheral side surfaces of the throttle plate 21 and the accelerator plate 36, as shown in FIGS. 2 and 3, the lead 61 is operated in correspondence with the relative positional relationships between these two members, and it is when the states shown in FIGS. 4A and 5B have occurred simultaneously that the lead 61 is spaced apart from the lead 62 and their contacts are set in the open state. In other words, this is the case where the amount of the accelerator pedal 34 operated is not more than a predetermined amount, i.e., the rotational angle of the accelerator plate 36 is not more than $\beta$, and the throttle plate 21 has been rotatively driven by exceeding the predetermined angle $\alpha$. Except for this case, the opposing contacts of the lead 61, 62 are in contact with each other.

It should be noted that although in the above-described embodiment the limit switch 60 is constituted by a single switch and the roller 63 is disposed in such a manner as to oppose the respective outer peripheries of the throttle plate 21 and the accelerator plate 36, the same function can be obtained if two lead switches are provided such that a pair of rollers are opposed to the throttle plate 21 and the accelerator plate 36, respectively, and these two lead switches are connected in parallel. In addition, although in the above-described embodiment the limit switch 60 is accommodated in the case 2, the lead switch for detecting the amount of the accelerator operated may be mounted on the cover 3 outside the case 2, and a sensor for directly detecting the amount of the accelerator pedal 34 operated may be provided. Furthermore, the same function can be obtained if an arrangement is provided such that, instead of the aforementioned two lead switches, two analog sensors, such as potentiometers or the like, are used and connected to a comparator, and a transistor serving as the switching means is turned on when either of their outputs is at a low level. Moreover, it is possible to use the accelerator sensor 37 and the throttle sensor 13 as such analog sensors. Additionally, the limit switch 60 can be arranged as a combination of a detector using the light of a photo-interruptor and a switching device, and a redundant system can be arranged by combining them with the aforementioned lead switches or analog sensors or the like.

When the amount of the accelerator pedal 34 operated is not more than a predetermined amount, i.g., in a case where the accelerator plate 36 is in the state shown in FIG. 2, the amount of operation is substantially zero, the throttle valve 11 is set in the open state, and its opening becomes large and exceeds a predetermined angle, i.e., if the throttle plate 21 rotates in the direction of arrow A shown in FIG. 2 by not less than the predetermined angle $\alpha$, then the roller 63 is brought into contact with the small-diameter portions of the throttle plate 21 and the accelerator plate 36, thereby causing the opposing contacts of the leads 61, 62 to open.

Figure 6:
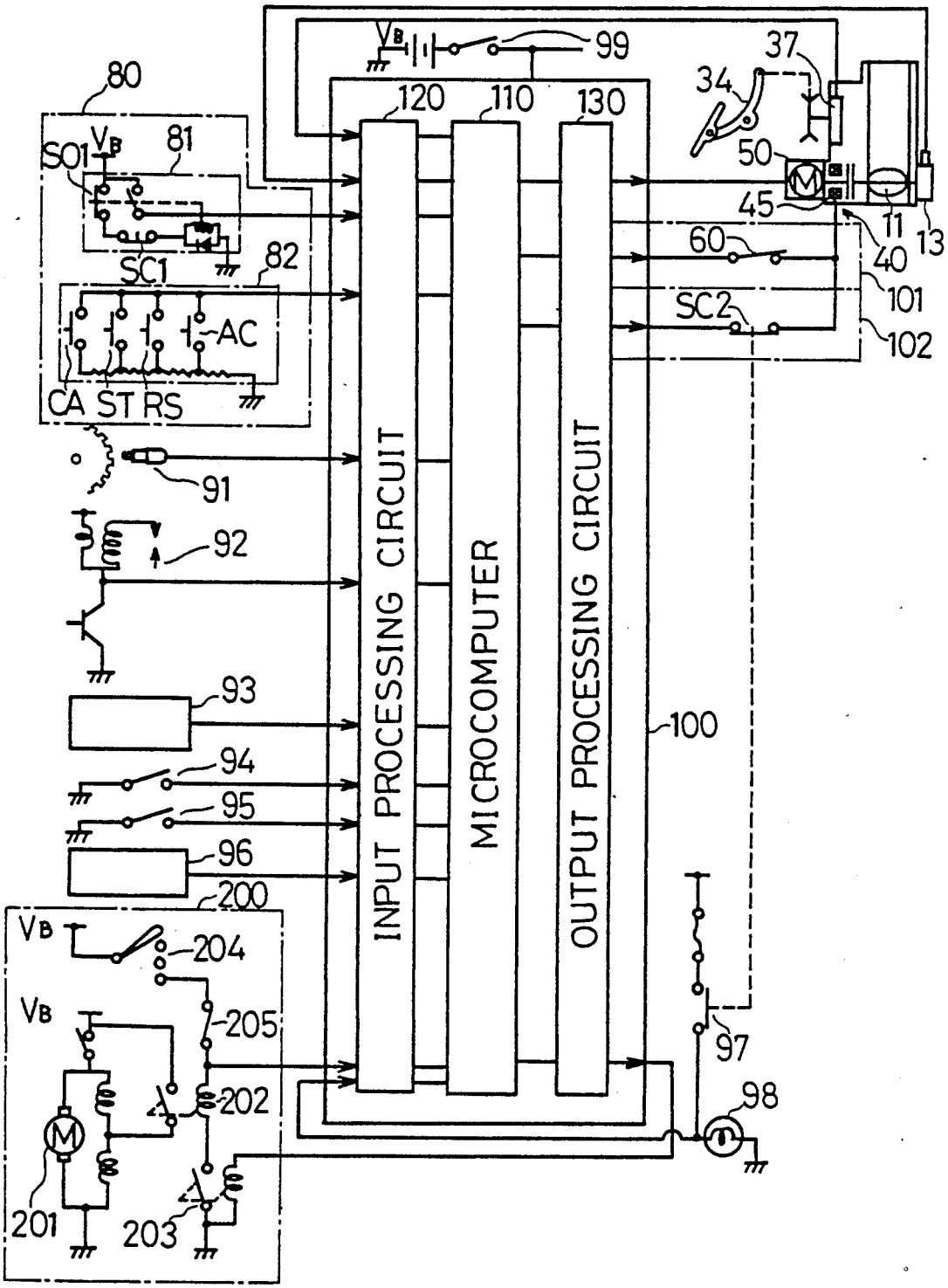
FIG. 6 is an overall circuit diagram of a controller and input/output devices.

The controller 100 is a control circuit including a microcomputer and has the function of the drive controlling means referred to in the present invention. Namely, the controller 100 is mounted in the vehicle, and detection signals of various sensors are input thereto, as shown in FIG. 6, so as to effect various types of control including control of the operation of the electromagnetic clutch mechanism 40 and the driving of the motor 50. In this embodiment, an arrangement is provided such that, in addition to control responsive to the normal operation of the accelerator pedal, various types of control, including constant-speed control and acceleration slip control, are effected.

Referring to FIG. 6, the controller 100 comprises a microcomputer 110, an input processing circuit 120 connected thereto, and an output processing circuit 130. The motor 50 is connected to the output processing circuit 130, while the coil 45 of the electromagnetic clutch mechanism 40 is connected to the output processing circuit 130 via a first energizing circuit 101 and a second energizing circuit 102. The controller 100 is connected to a power source $V_B$ via an ignition switch 99. It should be noted that as a power source switching means for the controller 100, a transistor and a relay that are energized when the ignition switch 99 is turned on, or another type of switching device may be used.

The accelerator sensor 37 is connected to the input processing circuit 120, and outputs a signal corresponding to the amount of the accelerator pedal 34 operated, i.e., an amount of pressing with the foot, this signal being input to the input processing circuit 120 together with the output signal of the throttle sensor 13. In the controller 100, the electromagnetic clutch mechanism 40 is subjected to on/off control in correspondence with the operating conditions, and the driving of the motor 50 is controlled in such a manner that a predetermined opening of the throttle valve 11 corresponding to the amount of the accelerator pedal 34 pressed, i.e., the throttle opening, can be obtained.

A switch 80 for constant-speed running control (hereinafter simply referred to as the constant-speed running switch 80) is connected to the input processing circuit 120. This constant-speed running switch 80 comprises a main switch 81 for turning on and off the power supply for the overall constant-speed running control system as well as a control switch 82 for conducting various types of control. The latter switch is constituted by a group of switches, as shown in FIG. 6, and has various known switching functions.

First, during running of the vehicle, if the main switch 81 is turned on and a set switch ST in the control switch 82 is turned on for a short time, the vehicle speed at that time is stored, and this vehicle speed is maintained, as will be described later. An accelerator switch AC is adapted to make fine adjustment of the set vehicle speed, and speed-increasing control is effected while this switch is on. Incidentally, fine adjustment for reducing the speed is automatically carried out if the aforementioned set switch ST is kept on, or if the set switch ST is turned on for a short time when the vehicle speed is reduced to a predetermined vehicle speed after cancelling the constant-speed running control by temporarily stepping on the brake pedal, then the vehicle speed is reset to the one persisting at that time. A cancel switch CA is a switch for canceling constant-speed running control. Cases where constant-speed running control is cancelled include such as the operation of the brake pedal, the shifting to the neutral position in an automatic transmission, and the operation of a parking brake. In addition, a resume switch RS is a switch for resetting the vehicle speed to the one persisting prior to the cancellation after the constant-speed running control is canceled by such operation.

A wheel speed sensor 91 is used for constant-speed running control, acceleration slip control, and the like, and a known electromagnetic pickup sensor, a hole sensor, or the like is used. Although in FIG. 6 only one wheel speed sensor is used, these wheel speed sensors are installed on respective wheels, as required. In addition, an ignition circuit unit, which is generally called an igniter, 92 is connected to the controller 100. An ignition signal is input to the igniter 92 and is used to detect the engine speed of the internal combustion engine.

A transmission controller 93 is a controller for controlling an automatic transmission system, and a speed change signal and a timing signal that are output thereby are supplied to the controller 100. A mode changeover switch 94 is to select an appropriate mode, as required, from among various operating modes that are stored in advance in the microcomputer 110 in the form of a map in correspondence with the various operating modes on the basis of the relationships of correspondence between the amount of the accelerator pedal 34 pressed and the opening of the throttle valve 11, so as to set the opening of the throttle valve 11 to a degree corresponding to the operating mode selected. As for these operating modes, it is possible to set such modes as the power mode, economy mode, highway running mode, street running mode, and so on. An acceleration slip control prohibit switch 95, when operated, outputs to the microcomputer 110 a signal for prohibiting its control when the driver does not wish to effect acceleration slip control by the microcomputer. A steering sensor 96 is used to determine whether or not the steering wheel has been manipulated at the time of conducting, for instance, acceleration slip control, and to permit a targeted slip rate to be set in correspondence with the result of that determination. A brake switch 97 is a switch which turns on and off in response to the operation of the unillustrated brake pedal. By operating this switch, a brake lamp 98 is lit, and the second energizing circuit 102 connected to the electromagnetic clutch mechanism 40 is opened, as will be described later.

In addition, a starter circuit 200 is for controlling the driving of a starter motor 201 and is arranged such that a second relay 203 is provided in series with a coil of a first relay 202 for controlling the opening and closing of a driving circuit for the starter motor 201, and that this second relay 203 is controlled in response to an output signal of the controller 100. A starter switch 204 is connected in series with the first relay 202 and the second relay 203, and in the case of a vehicle provided with an automatic transmission system a neutral start switch 205 is interposed therebetween. If the unillustrated automatic transmission system is in the neutral position, this neutral switch 205 remains on, and if the starter switch 204 is turned on in this switch, the coil of the first relay 202 is energized if the second relay 203 is on, with the result that the driving circuit for the starter motor 201 is turned on, thereby driving the starter motor 201.

At the time when an initial check is made as to whether or not the throttle controller functions of this embodiment properly, even if the starter switch 204 is turned on, the second relay 203 is set to the off state, and the starter motor 201 is made inoperative until a confirmation is made by opening and closing the throttle valve 11. Consequently, it is possible to obviate the overrevolution of the engine at the time of conducting an initial check of the throttle controller.

Figure 7:
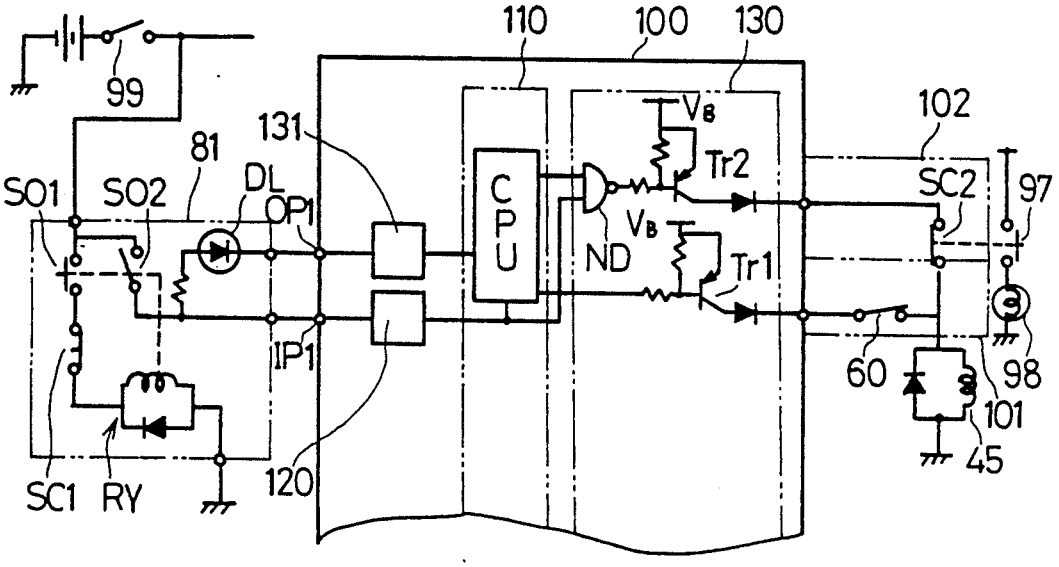
FIG. 7 is an electrical circuit diagram concerning the start of operation of constant-speed running control by the controller shown in FIG. 6 as well as a stopping means.

Referring now to FIG. 7, a detailed description will be given of means for starting and stopping the operation of constant-speed running control in the above-described controller 100. In FIG. 7, in the main switch 81, a normally open switch SOl and a normally closed switch SC1 are connected in series with the power source $V_B$ and are grounded via a relay RY. In addition, an input terminal IP1 of the controller 100 is connected to the power source $V_B$ via a normally open switch SO2 in parallel with these switches, while an output terminal OP1 of the controller 100 is connected to the normally open switch SO2 via a light-emitting diode DL. As a result, once the ignition switch 99 is turned off, unless the main switch 81 is operated, the constant-speed running control cannot be operated in this arrangement.

The input terminal IP1 is connected to the microcomputer 110 via the input processing circuit 120, and is also connected to one input terminal of an NAND gate ND of the output processing circuit 130, while the output terminal OP1 is connected to a driving circuit 131. An output of the microcomputer 110 is used as an input to the base of a transistor Tr1 whose emitter is connected to the power source $V_B$, and its collector is connected to the coil 45 of the electromagnetic clutch mechanism 40 via the limit switch 60, thus constituting the first energizing circuit 101. In addition, an output of the NAND gate ND is used as an input to the base of a transistor Tr2 whose emitter is connected to the power source $V_B$, and its collector is connected to the coil 45 via the normally closed switch SC2 which is interlocked with the brake switch 97, thus constituting the second energizing circuit 102. It should be noted that the microcomputer 110 incorporates a CPU, a ROM, a RAM, etc., which are connected to input/output ports via common bus; however, only the CPU is shown in FIG. 7.

The aforementioned transistor Tr1 controls the energization of the coil 45, and is maintained in an energizing state insofar as the throttle controller is properly functioning. The transistor Tr2 controls the energization of the coil 45 mainly during constant-speed running control so as to effect control of the driving of the electromagnetic clutch mechanism 40. The arrangement of the transistor Tr2 is such that when the main switch 81 is on and the set switch ST, shown in FIG. 6, of the control switch 82 is operated, the transistor Tr2 is turned on by the microcomputer 110. Accordingly, unless the main switch 81 is on, the transistor Tr2 is off, and the energization of the coil 45 by the energizing circuit 102 is shut off, so that the throttle valve 11 is prevented from being driven by the motor 50. In addition, the first controlling means and the second controlling means referred to in the present invention are constituted by the first energizing circuit 101 and the second energizing circuit 102 as well as the controller 100.

Figure 8:
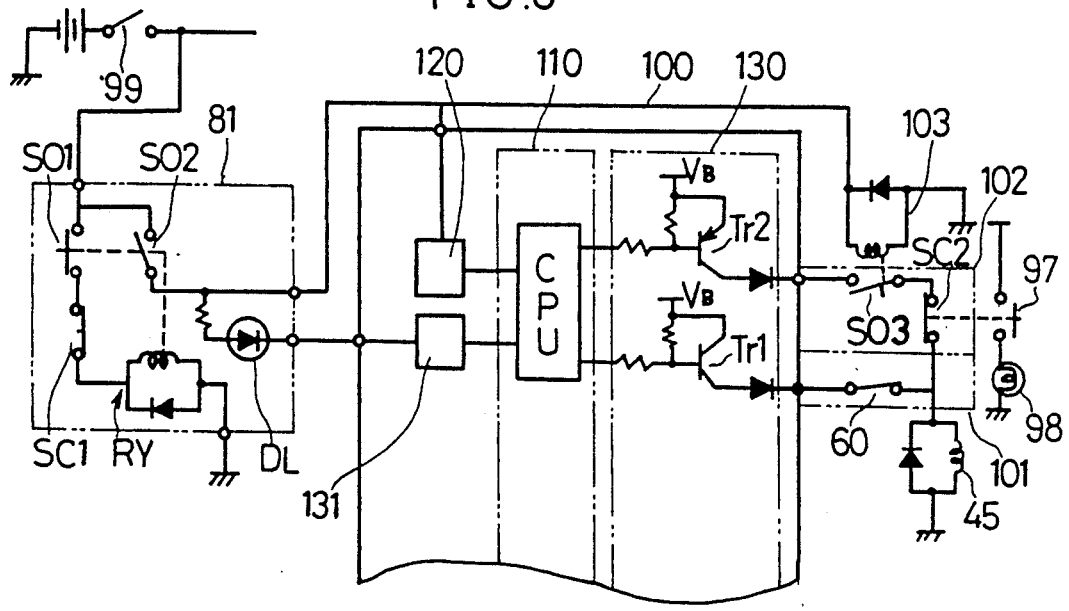
FIG. 8 is an electrical circuit diagram in accordance with another embodiment of the configuration shown in FIG. 7.

FIG. 8 shows another embodiment of the means for starting and stopping the operation of constant-speed running control by the aforementioned controller 100. In this embodiment, a relay 103 is connected in series with the main switch 81 for constant-speed running control, and a normally open switch SO3 driven by this relay 103 is interposed in the second energizing circuit 102. As a result, as compared with the embodiment shown in FIG. 7, it is possible to configure the circuit outside the controller 100 without requiring the NAND gate ND. The remaining configuration is similar to that of the embodiment shown in FIG. 7. The turning on of the normally open switch SO1 of the main switch 81 excites the relay 103, which in turn causes the normally open switch SO3 to turn on, thereby closing the second energizing circuit 102. As a result, the set switch ST of the control switch 82 is operated, and when the transistor Tr2 is turned on by the output of the microcomputer 110, the coil 45 is energized. On the other hand, the turning off of the normally closed switch SC1 or the turning off of the ignition switch 99 turns on the normally open switch SO2, with the result that the relay 103 ceases to be excited, and the normally open switch SO3 is turned off, thereby shutting off the energization of the coil 45. In other words, the constant-speed running control is prohibited unless the driver turns on the main switch 81.

Figure 9:
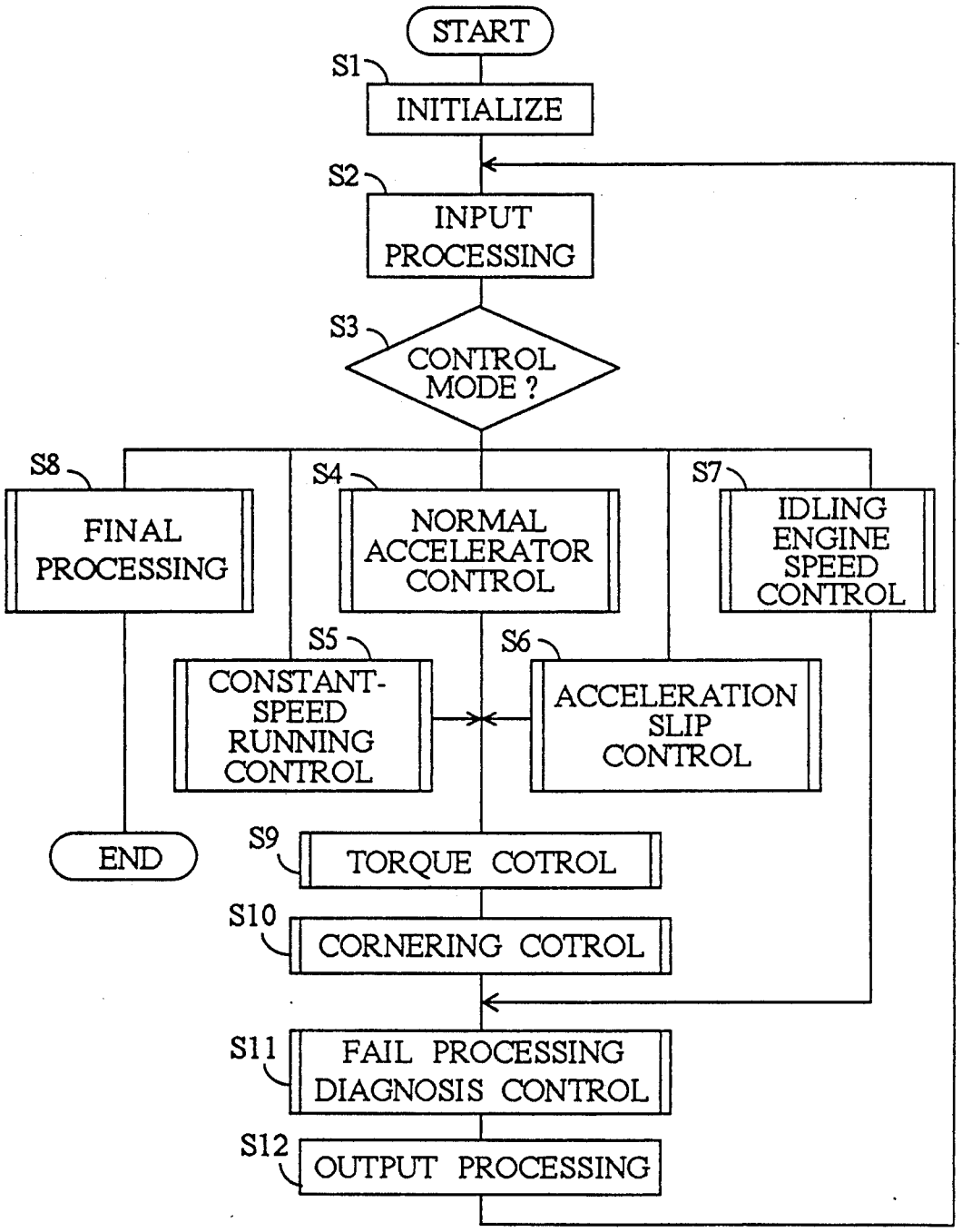
FIG. 9 is a flowchart illustrating the operation of the embodiment shown in FIGS. 2 to 7.

A description will be given of the operation of the embodiment arranged as described above. The flowchart shown in FIG. 9 illustrates the overall operation of the throttle controller in accordance with this embodiment. In the controller 100, initialization is conducted in Step S1, the aforementioned various types of input signals are processed by the input processing circuit 120 in Step S2, and the operation proceeds to Step S3 in which a control mode is selected in correspondence with these input signals. That is, any one of the Steps S4 to S8 is selected.

When control of one of the Steps S4 to S6 is conducted, torque control and cornering control are effected in Steps S9 and S10, respectively. In the former control, throttle control is effected in such a manner as to alleviate the shock at the time of speed change, while in the latter control, throttle control is effected in correspondence with a steering angle of the unillustrated steering wheel. Since these operations are not directly related to this embodiment, a description thereof will be omitted. It should be noted that idling engine speed control in Step S7 is effected so that the idling engine speed will be maintained at a fixed value even if the engine condition undergoes a change, while in Step S8 postprocessing after the ignition switch 99 is set to off is carried out.

Subsequently, in Step S11 self-diagnosis is effected by diagnosis means and fail processing is conducted, output processing is carried out in Step S12 to drive the electromagnetic clutch mechanism 40 and the motor 50 via the output processing circuit 130. Thus, the aforementioned routine is repeated in predetermined cycles.

In the overall operation described above, a description will be given of the operation at the time of normal accelerator control in Step S4. When the accelerator pedal 34 is not being operated, i.e., when the throttle valve 11 is fully closed, the throttle plate 21 and the accelerator plate 36 are at the positions shown in FIG. 2. In addition, the transistor Tr2 shown in FIG. 7 is off and the second driving circuit 102 is in the open state. However, the transistor Tr1 is in the on state, and if the limit switch 60 is also in the on state, the coil 45 of the electromagnetic clutch mechanism 40 is energized via the first driving circuit 101.

When the coil 45 is energized and both the fixed yoke 44 and the movable yoke 43 are excited, the clutch plate 42 is coupled with the movable yoke 43, assuming a state in which the driving force of the motor 50 is imparted to the throttle shaft 12. Subsequently, unless an abnormal state which will be described later occurs, the throttle shaft 12 is rotatively driven by the motor 50, with the result that the opening of the throttle valve 11 is controlled as the motor 50 is controlled by the controller 100.

Figure 10:
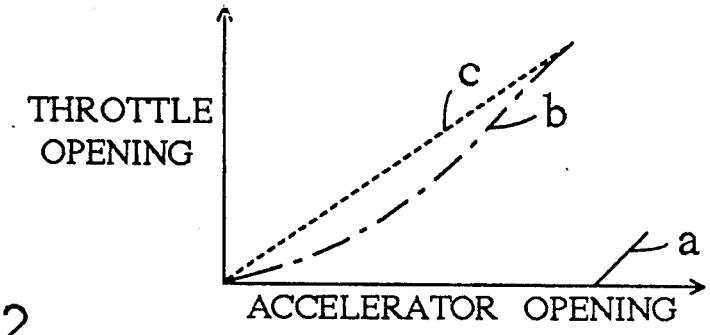
FIG. 10 is a characteristic diagram illustrating the relationships between the accelerator opening and the throttle opening.

Namely, during normal accelerator control, if the accelerator pedal 34 is pressed, the accelerator link 31 rotates against the urging force of the return spring 35 in correspondence with the amount of the operation. As a result, the accelerator plate 36 rotates in the direction of arrow A shown in FIG. 2, and the on state of the limit switch 60 is maintained. At the same time, the rotational angle of the accelerator plate 36 corresponding to the amount of the accelerator pedal 34 operated is detected by the accelerator sensor 37 interlocked via the pin 36*c* shown in FIG. 2. The detected output of the accelerator 37 is input to the controller 100 where a predetermined targeted throttle opening corresponding to the rotational angle of the accelerator plate 36 is determined. For instance, an opening of the accelerator, i.e., a targeted throttle opening corresponding to the rotational angle of the accelerator plate 36, is set on the basis of, for instance, characteristic "b" or "c" shown in FIG. 10. When the motor 50 is driven and the throttle shaft 12 is rotated, a signal corresponding to that rotational angle is output from the throttle sensor 13 to the controller 100, and the driving of the motor 50 is controlled by the controller 100 in such a manner that the opening of the throttle valve 11 becomes substantially equal to the aforementioned targeted throttle opening. Then, throttle control is effected in correspondence with the amount of the accelerator pedal 34 operated, and an engine output corresponding to the opening of the throttle valve 11 is thereby obtained.

It should be noted that, during the aforementioned operation of the throttle valve 11, the accelerator plate 36 and the throttle plate 21 do not engage with each other and the accelerator plate 36 follows the rotation of the throttle plate 21 at a predetermined angle. Accordingly, mechanically linked relation between the accelerator pedal 34 and the throttle valve 11 does not occur, and it is possible to secure smooth starting and running in response to the operation of the accelerator pedal 34. Then, if the pressing of the accelerator pedal 34 is canceled, the accelerator link 31 is returned to its initial position by means of the urging force of the return spring 35 and the driving force of the motor 50, and the throttle valve 11 is also returned to its fully closed position.

During the above-described normal accelerator control, when the throttle valve 11 has operated abnormally, if the operation of the accelerator pedal 34 is canceled to set the accelerator pedal 34 in the nonoperative state, the accelerator plate 36 is returned to its initial position by means of the return spring 35, and the accelerator plate 36 and the throttle plate 21 are respectively set in the states shown in FIGS. 4A and 5B. If the limit switch 60 is thus set to off, the first energizing circuit 101 is opened, as is apparent from FIG. 7. Moreover, since the transistor Tr2 is off and the second energizing circuit 102 is in the open state, the energization of the coil 45 is not effected, and the movable yoke 43 and the clutch plate 42 of the electromagnetic clutch mechanism 40 are separated from each other. Then, the driving of the throttle valve 11 by the driving plate 41 is stopped, and the throttle valve 11 is returned to its initial position by the return spring 22.

A description will now be given of the operation at the time of constant-speed running control in Step S5. Referring to FIG. 7, if the driver presses the normally switch SO1 of the main switch 81, the relay RY is exited, and the normally open switches SO1, SO2 are closed and are held in that state. As a result, the power source $V_B$ is connected via the input terminal IP1 to the input processing circuit 120 where the voltage is converted to a predetermined voltage, and its output is supplied to one input terminal of the NAND gate ND and is also delivered to the CPU of the microcomputer 110. Then, when the set switch ST of the control switch 82 shown in FIG. 6 is operated, the voltage output is supplied from the microcomputer 110 to the other input terminal of the NAND gate ND. As a result, the transistor Tr2 is turned on, and the current is supplied to the coil 45 via the normally closed switch SC2, thereby exciting the coil 45.

In this case, if the accelerator pedal 34 is set in the nonoperative state when the opening of the throttle valve 11 is not more than a predetermined opening, the limit switch 60 is set to the off state, and the first energizing circuit 101 is opened. However, since the energization of the coil 45 is continued via the second energizing circuit 102 during constant-speed running control, the throttle shaft 12 is connected to the motor 50 via the electromagnetic clutch mechanism 40.

Then, a targeted throttle opening is set in correspondence with a difference between the vehicle speed detected by the wheel speed sensor 91 and the vehicle speed set by the set switch ST, and the driving of the throttle valve 11 is controlled by means of the motor 50 to the targeted throttle opening.

When passing acceleration or the like is required during constant-speed running, and when upon pressing the accelerator pedal 34 the throttle opening corresponding to the amount of the accelerator pedal 34 pressed has exceeded the targeted throttle opening set at the time of constant-speed running control, the mode is changed to the override mode, and this targeted throttle opening is substituted by the set opening of the normal accelerator control mode.

In cancelling the constant-speed running control, with reference to FIG. 6, if the driver operates the cancel switch CA of the control switch 82 or operates the normally closed switch SC1 and turns off the main switch 81, the transistor Tr2 shown in FIG. 7 turns off, thereby opening the second driving circuit 102. The same is true if the ignition switch 99. In addition, if the brake pedal has been operated, if the normally closed switch SC2 interlocked with the brake switch 97 turns off, thereby opening the second driving circuit 102. Subsequently, throttle control during the aforementioned normal accelerator control is conducted via the first driving circuit 101.

Then, if the driver has touched the set switch ST by mistake, or the microcomputer 110 has malfunctioned due to radio interference or the like, unless the driver operates the normally open switch SO1 of the main switch of his or her own will, the situation does not occur in which the throttle valve 11 is automatically opened.

Figure 11:
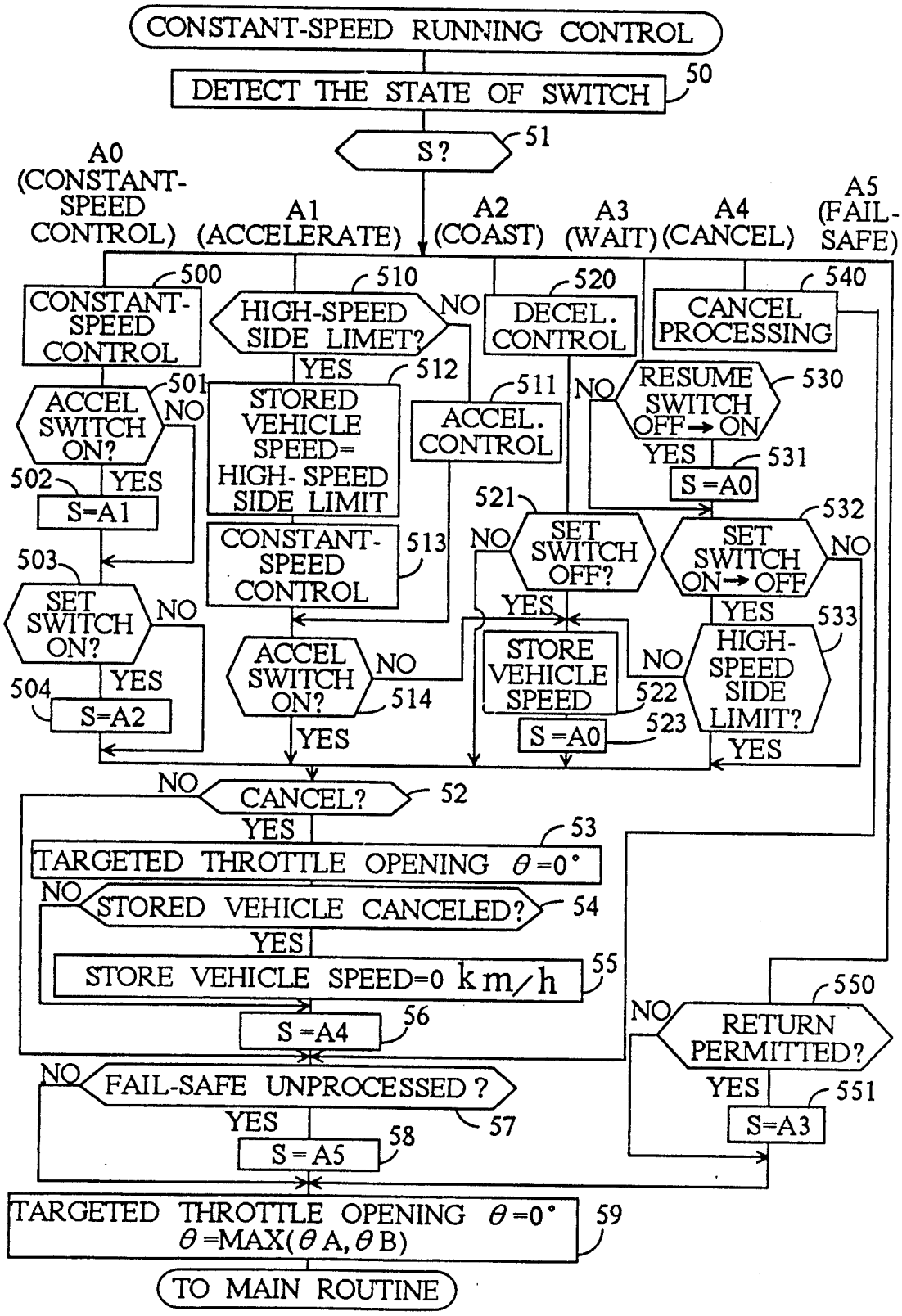
FIG. 11 is a flowchart of constant-speed running control.

The specific contents of processing of the constant-speed running control in Step S5 shown in FIG. 9 are shown in FIG. 11. When the main switch 81 for constant-speed running control is turned on, the following processing is carried out. First, in Step 50, the state of each switch of the control switch is detected. Then, processing A0 to A5 shown in FIG. 11 is selected in correspondence with the state of each switch and specific conditions, and processing items are sequentially executed in correspondence with the state of each switch and the like, as will be described later.

Next, a determination is made as to whether or not is made as to whether or not constant-speed running control has been canceled (Step 52), and, if YES is the answer, after setting the targeted throttle opening to zero (Step 53), the stored vehicle is canceled (Steps 54, 55). The operation then proceeds to cancellation processing (A4) (Step 56). Furthermore, a determination is made as to whether or not the operation has gone through fail-safe processing (A5) (Step 57), and if YES is the answer, the operation proceeds to Step 59, while if NO is the answer, the operation proceeds to fail-safe processing (A5) (Step 58). Then, in Step 59, a larger one of a throttle opening $\theta_A$ corresponding to the accelerator opening and a throttle opening $\theta_B$ set at the time of constant-speed control is set as a targeted throttle opening $\theta$, and the operation then returns to the main routine. That is, the accelerator pedal 34 is operated, and if the throttle opening $\theta_A$ caused by this operation is greater than the set throttle opening $\theta_B$, the throttle opening is replaced by the throttle opening $\theta_A$. In consequence, the override mode can be provided without requiring any link mechanism.

The aforementioned processing A0 to A5 is executed as follows: The constant-speed processing (A0) consists of Steps 500 to 504, and throttle opening $\theta_B$ is adjusted in accordance with a difference between the stored vehicle speed and the actual vehicle speed is adjusted in such a manner as to maintain the set vehicle speed (Step 500). When the accelerator switch AC shown in FIG. 6 is operated and is turned on, acceleration processing (A1) is effected (Steps 501, 502). Then, when the set switch ST is operated and turned on, coast processing (A2) is effected (Steps 503, 504).

The acceleration processing (A1) is constituted by Steps 510 to 514, and acceleration control is effected up to a predetermined high-speed side limit insofar as the accelerator switch AC is operative (Steps 510, 511, 514). When the vehicle is accelerated up to the limit, constant-speed control is effected by using that value as the stored vehicle speed (Steps 512, 513). Accordingly, if the on state of the accelerator switch AC is being kept, the stored vehicle speed in the meantime is renewed sequentially to the high-speed side.

In the coast processing (A2) in Steps 520 to 523, deceleration is effected at a fixed rate of deceleration while the set switch ST is operative (Steps 520, 521). When the set switch ST turns off, the vehicle speed at that time is stored and the operation proceeds to fixed-speed control processing (A0) (Steps 522, 523).

Wait processing (A3) consists of Steps 530 to 533, and when the resume switch RS has shifted from off to on, the operation proceeds to constant-speed control processing (A0) (Steps 530, 531). If NO is the answer in Step 530, a determination is made as to the state of the set switch ST, and if the set switch ST has shifted from on to off, a determination is made as whether or not a high-speed side limit has been reached (Steps 532, 533). If YES is the answer, the vehicle speed at that time is stored and the operation proceeds to constant-speed control processing (A3) (Steps 522, 523). In fail-safe processing (A5), a determination is made as to whether or not a return is allowed. If YES is the answer, the operation is subjected to wait processing (A3) (Steps 550, 551).

Figure 12:
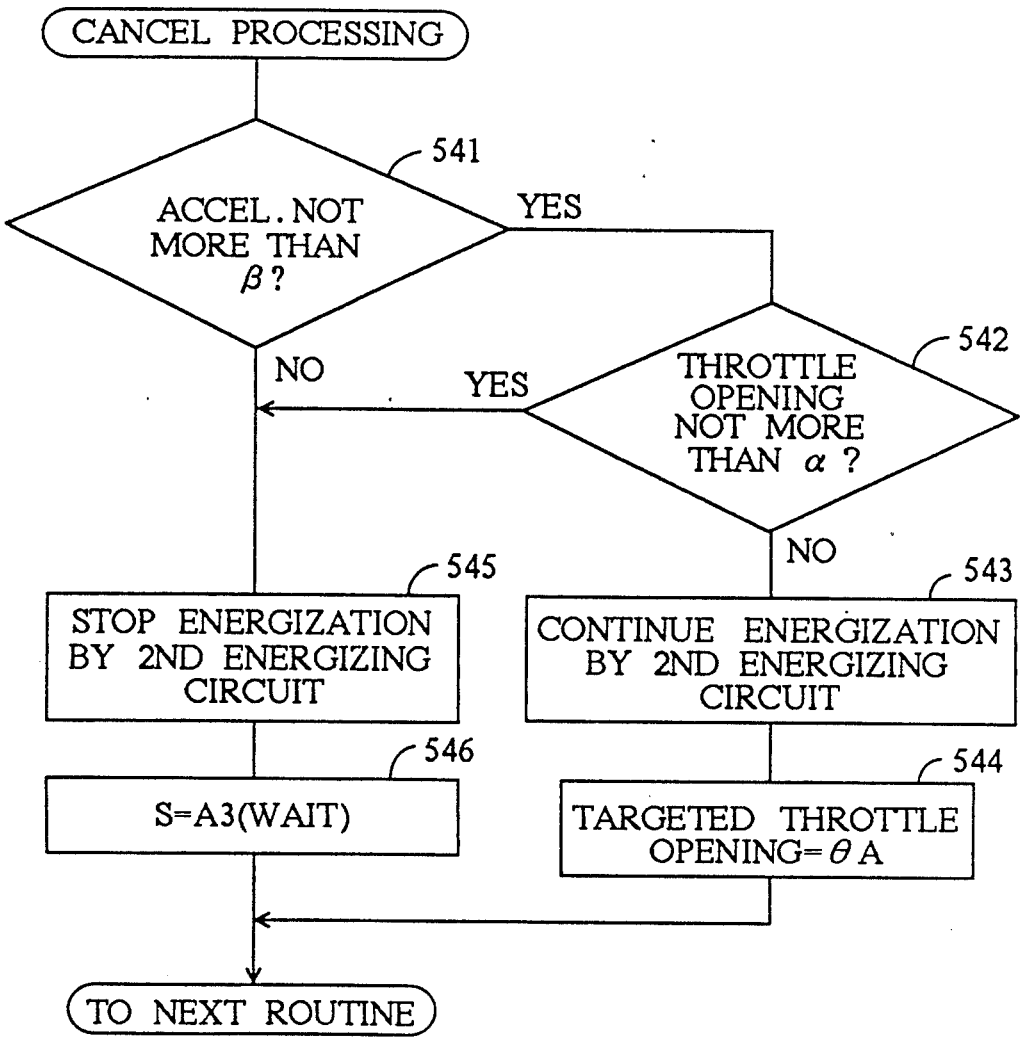
FIG. 12 is a flowchart of cancellation processing of constant-speed running control.

As for the above-described constant-speed running control, a detailed description will be given of cancel processing (A4) with reference to the flowchart shown in FIG. 12. If cancel processing (A4) is selected during constant-speed running control, after a determination is made of its state in Step 51 of FIG. 11, a determination is made in Step 541 of FIG. 12 as to whether or not the accelerator opening, i.e., the rotational angle of the accelerator plate 36 in FIG. 4, is not more than a predetermined value $\beta$. The state that the rotational angle of the accelerator plate 36 is not more than $\beta$ means that the accelerator pedal 34 is in the nonoperative state. If YES is the answer in Step 541, the operation proceeds to Step 542 where a determination is made as to whether or not the opening of the throttle valve 11 is not more than a predetermined value $\alpha$. That is, a determination is made as to whether or not the throttle plate 21 is in the state shown in FIG. 5A.

When the vehicle is under constant-speed running control, the throttle opening is not zero and the rotational angle of the throttle plate 21 has exceeded the predetermined angle $\alpha$, as shown in FIG. 5B. Hence, the operation proceeds to Step 543 where control is effected such that the transistor Tr2 in the controller shown in FIG. 7 will turn on, and the energization of the coil 45 via the second energizing circuit 102 is continued. Then, in Step 544, the targeted throttle opening $\theta$ is set to the throttle opening $\theta_A$ corresponding to the accelerator opening, and throttle control is continued as an extension of the constant-speed running control.

If it is determined in Step 541 that the accelerator opening has exceeded the predetermined value $\beta$, or if it is determined in Step 542 that the throttle opening is not more than the predetermined value $\alpha$, the energization by the second energizing circuit 102 is stopped, and the operation proceeds to normal accelerator control via the first energizing circuit 101. Then, in Step 546, the operation is subjected to wait processing (A3). That is, after canceling the constant-speed running control, if the accelerator pedal 34 is operated and the accelerator opening exceeds the predetermined value $\beta$ while throttle control is being carried out in Steps 543 and 544, then normal accelerator control is effected. Then, a sudden decline in the throttle opening at the time of cancellation of constant-speed running control is obviated, and smooth throttle control is effected. In addition, it is possible to reduce the frequency of engagement and disengagement of the electromagnetic clutch mechanism 40 occurring as the limit switch 60, which is set in the off state at the time of cancellation, is immediately turned on by the operation of the accelerator pedal. As a result, the durability of the electromagnetic clutch mechanism 40 can be assured.

It should be noted that, in accordance with the throttle controller of the above-described embodiment, should the motor 50 or the controller 100 become inoperative, it is possible to continue the running of the vehicle by operating the accelerator pedal 34. In short, as is apparent from FIGS. 4A, 4B and 5A, 5B, as the accelerator pedal 34 is pressed by more than a predetermined amount, the arm 36*b* of the accelerator plate 36 rotates toward the pin 23 of the throttle plate 21, thereby causing the arm 36*b* to engage the pin 23. As a result, the movable yoke 43 is driven in the direction in which the throttle valve 11 is opened, and a fixed opening is secured as indicated at "a" in FIG. 10, so that the driver is capable of continuing the running of the vehicle, though at low speed.

Since the throttle controller in accordance with the present invention is arranged as described above, the present invention offers the following advantages.

That is, with the throttle controller of the present invention, during normal accelerator control, adjustment of the throttle valve opening is effected by the driving means irrespective of the accelerator operating mechanism by connecting the throttle opening and closing means and the driving means via the clutch means. Accordingly, it is possible to effect smooth starting and running of the vehicle in response to the operation of the accelerator and, at the same time, various types of control, including constant-speed running control, can be effected with ease. In particular, control of the driving of the clutch means by the drive controlling means can be permitted by means of the second controlling means separately from the first controlling means. Accordingly, it is possible to effect constant-speed running control positively irrespective of the operation of the accelerator.

Thus, since a setting can be provided such that except at the time of, for instance, constant-speed running control, the throttle valve will not open unless the accelerator pedal is operated, the possibility of the throttle valve operating abnormally due to a malfunctioning of the drive controlling means is obviated. In addition, even if the driving means has operated abnormally in the direction in which the throttle valve is opened during the normal accelerator control, control of the driving of the clutch means by the drive controlling means is permitted by means of the first and second detecting means and the first controlling means through a simple and positive method in which the operation of the accelerator is made inoperative. As a result, the driving means can be separated positively from the throttle opening and closing means.

Moreover, in cases where constant-speed running control is canceled during constant-speed running control with the accelerator pedal set in the nonoperative state, the throttle opening and closing means and the driving means are not separated and the coupled state is continued by means of the second controlling means until the amount of the accelerator operated exceeds a predetermined amount of operation. Accordingly, it is possible to effect smooth throttle control without causing a sudden decline in the throttle opening. In addition, the frequency of operation of the clutch means can be held down to a necessary minimum.

What is claimed is:

1. A throttle controller including throttle opening and closing means for opening and closing a throttle valve, urging means for urging said throttle opening and closing means in a direction in which said throttle valve is closed, an accelerator operating mechanism, driving means capable of driving said throttle opening and closing means independently of said accelerator operating mechanism in directions in which said throttle valve is opened and closed, a driving source for rotatively driving said driving means, clutch means for connecting and disconnecting said throttle opening and closing means and said driving means, and drive controlling means for controlling the engagement and disengagement of said clutch means and controlling the driving of said driving source in response to at least the accelerator operation of said accelerator operating mechanism, said throttle controller comprising:

first detecting means for outputting a signal corresponding to an amount of the accelerator operation of said accelerator operating mechanism;

second detecting means for outputting a signal corresponding to an opening of said throttle valve;

first controlling means for permitting drive control by said drive controlling means in such a manner that said clutch means separates said throttle opening and closing means from said driving means, when an output signal of said first detecting means is a signal representative of an amount of operation not more than a predetermined amount of accelerator operation and when an output signal of said second detecting means is a signal representative of an opening exceeding a predetermined throttle opening; and second controlling means disposed in parallel with and independently of said first controlling means and adapted to permit control of the driving of said clutch means by said drive controlling means, said second controlling means permitting control of the driving of said clutch means by said drive controlling means in such a manner that said clutch means connects said throttle opening and closing means and said driving means, when an output signal of said first detecting means is a signal representative of an amount of operation not more than said predetermined amount of accelerator operation and when an output signal of said second detecting means is a signal representative of an opening exceeding said predetermined throttle opening.

2. A throttle controller according to claim 1, wherein said second controlling means permits control of the driving of said clutch means by said drive controlling means, during constant-speed running control for effecting control in such a manner that the opening of said throttle valve maintains vehicle speed at a constant speed.

3. A throttle controller according to claim 2, wherein said clutch means is constituted by an electromagnetic clutch mechanism, first controlling means and said second controlling means respectively including a first energizing circuit and a second energizing circuit respectively connected to said electromagnetic clutch clutch mechanism, and switching means being disposed in said second energizing circuit in series therewith and adapted to switch on and off energization of said electromagnetic clutch mechanism in interlinking relation with a brake pedal of a vehicle.

* * * * *